US007424959B1

(12) United States Patent
Biebel

(10) Patent No.: US 7,424,959 B1
(45) Date of Patent: Sep. 16, 2008

(54) PAINT TRAY TROLLEY

(76) Inventor: David R. Biebel, 104 Averlon Ave., Apt. 24, Erie, PA (US) 16509

( * ) Notice: Subject to any disclaimer, the term of this patent is extended or adjusted under 35 U.S.C. 154(b) by 708 days.

(21) Appl. No.: 10/947,083

(22) Filed: Sep. 21, 2004

(51) Int. Cl.
*B65D 21/02* (2006.01)

(52) U.S. Cl. ..... 220/23.87; 220/570; 15/257.06

(58) Field of Classification Search ..... 220/23.87, 220/570; 280/38; 15/257.06
See application file for complete search history.

(56) References Cited

U.S. PATENT DOCUMENTS 3,663,982 A * 5/1972 Hayden ..... 15/257.01
5,190,303 A * 3/1993 Schumacher et al. ..... 280/38
7,194,786 B2 * 3/2007 Gagne ..... 16/406

* cited by examiner

*Primary Examiner*—Anthony D. Stashick
*Assistant Examiner*—Harry A Grosso
(74) *Attorney, Agent, or Firm*—Richard K Thomson

(57) ABSTRACT

A base is equipped with wheels to receive a paint tray with stabilizing feet and enable the tray to be moved from place to place without the need to pick it up. An upwardly extending flange can be engaged by the paint roller to push/pull it to a new location.

8 Claims, 3 Drawing Sheets

PAINT TRAY TROLLEY

BACKGROUND AND SUMMARY OF THE INVENTION

The present invention is in the field of painting accessories. More particularly, the present invention is directed to a trolley for a paint tray to permit a painter to easily move the tray from place to place without having to stoop and pick it up.

Professional painters and the more experienced do-it-yourselfers use 1 gallon paint trays, rather than the smaller 1 quart variety. When doing a big job, the workman is able to spend more time painting walls, ceilings, etc., and less time opening and resealing cans. In addition, the painting professional utilizes an extensible handle for her/his roller and stands on the floor so as to avoid climbing up and down a ladder. Again, this enables the painter to make better use of her/his time. The problem, then, becomes stooping to pick up the paint tray and move it from place to place as the painting progresses. This puts significant strain on the lower back and risks a work-related injury.

The paint tray trolley of the present invention permits a worker to use her/his paint roller to push/pull the paint tray from place to place. The casters used on the trolley are robust enough to allow the trolley/tray to glide over drop cloths, carpeting, and other obstructions which may be on the floor.

The 1 gallon paint tray has a sloping bottom, two ends and two sides forming a contiguous peripheral wall, and two clips underlying the sloping bottom permitting the paint tray to be mounted upon a step of a ladder or, simply serving to level the top edge of the tray. The trolley of the present invention comprises a base underlying at least a portion of the conventional paint tray, the base having means to accommodate the two clips which are beneath the sloping bottom; two side walls extending upwardly from the base engaging the two sides of the paint tray to inhibit relative lateral motion between the trolley and the paint tray; front and back walls extending upwardly from the base contiguous with the two side walls, the front and back walls engaging the two end walls of the paint tray to inhibit relative longitudinal movement between the trolley and the paint tray; rotational support means beneath and attached to the base to permit the paint tray trolley to be moved from place to place without a need for the trolley to be picked up.

The paint tray trolley also includes upwardly extending flange means attached to one of the front and back walls, the flange means being engageable by a paint roller to facilitate manipulation of the paint tray trolley. The flange means has a slot formed between a first portion and a second portion to accommodate a handle of the paint roller.

The base of the paint tray trolley further includes a first downwardly sloping floor portion underlying at least a portion of the sloping bottom of the paint tray, the first downwardly sloping floor portion lying between two portions of the means to accommodate the two clips. Second and third auxiliary sloping floor portions lie laterally outwardly from the means to accommodate the two clips. The rotational support means is a plurality of wheels attached to a lower side of said base and, preferably, at least two of the plurality of wheels comprise casters capable of rotation about a generally vertical axis to facilitate lateral movement of said paint tray trolley. More preferably, there are four such wheels, all of which are casters.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
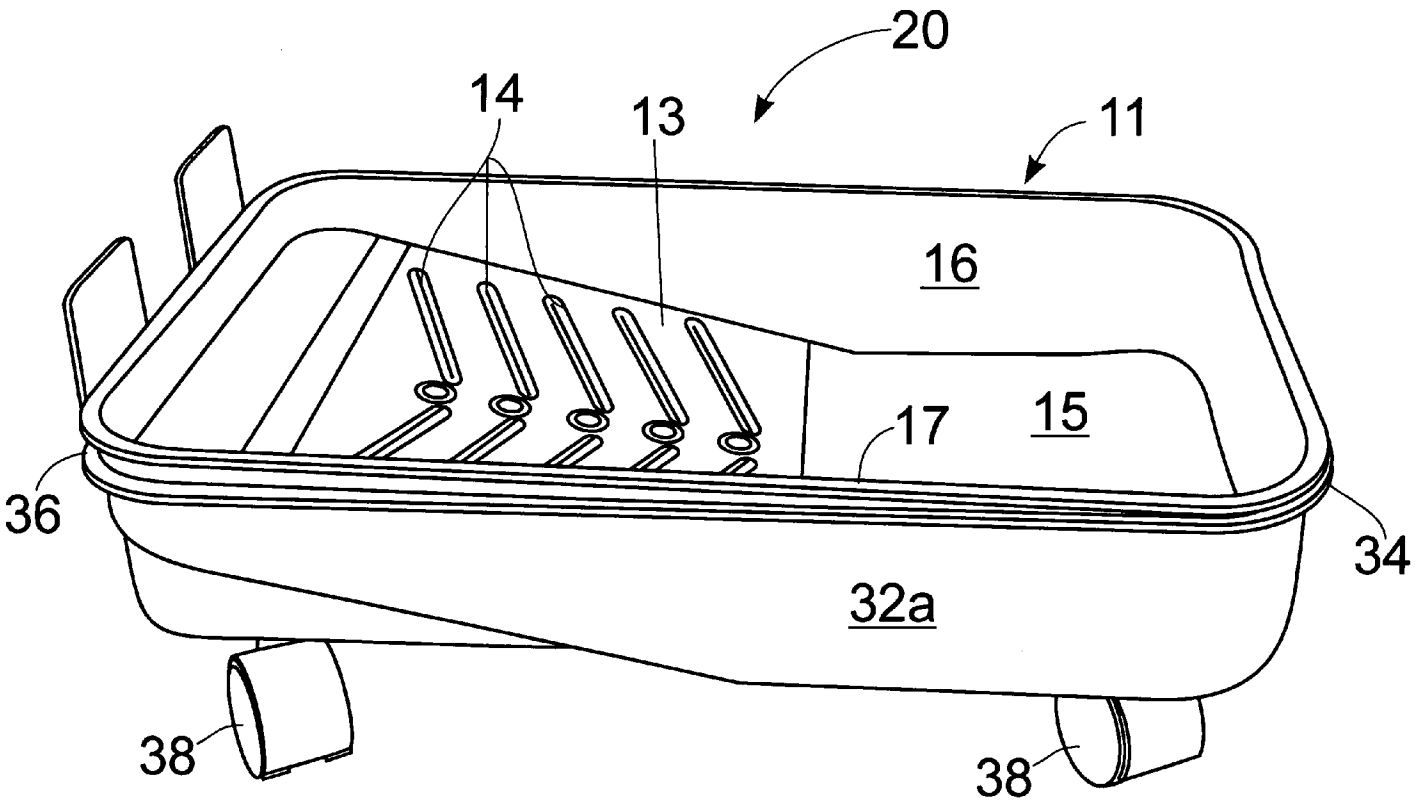
FIG. 1 is a side perspective view of a first embodiment of the paint tray trolley of the present invention carrying a paint tray.
Figure 2:
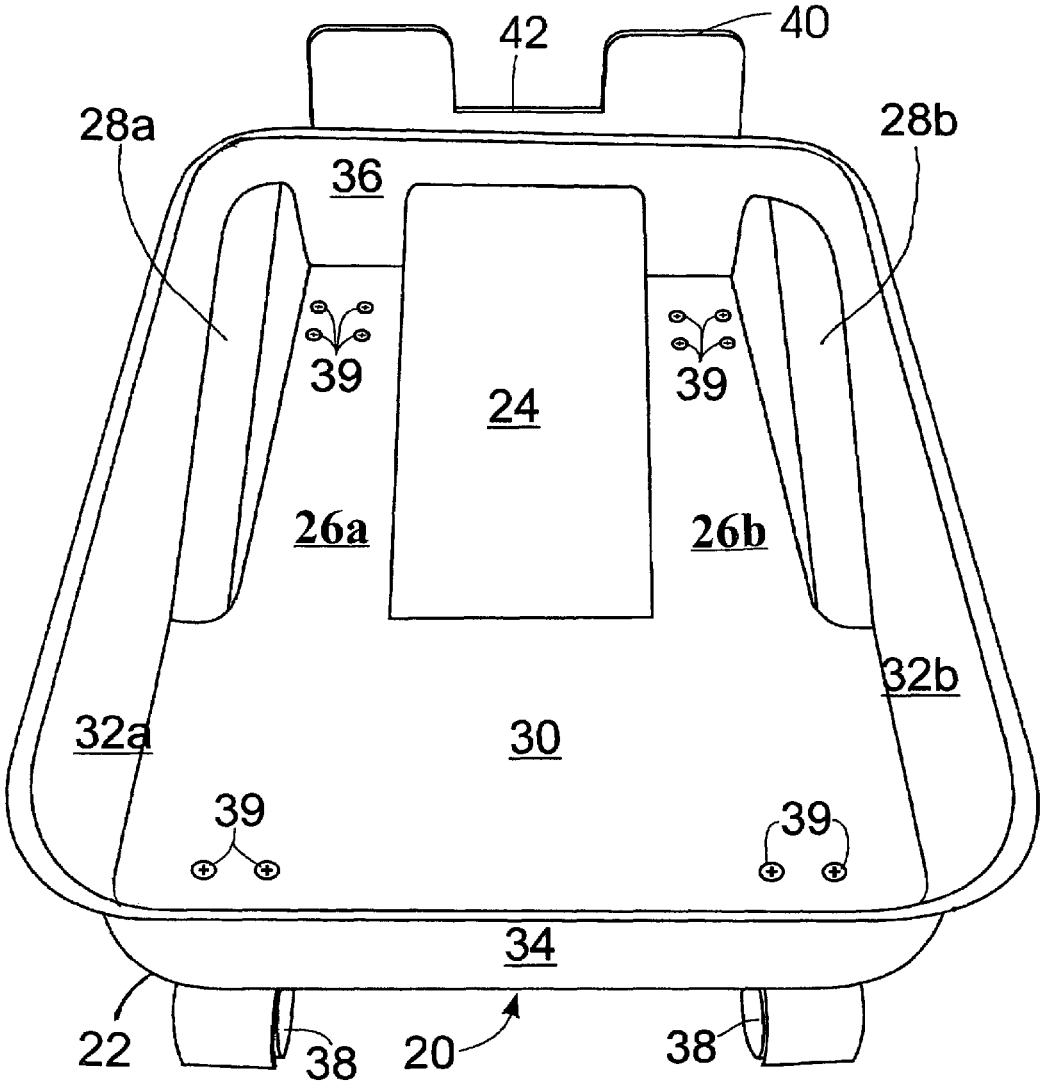
FIG. 2 is a front perspective view of the first embodiment.
Figure 3:
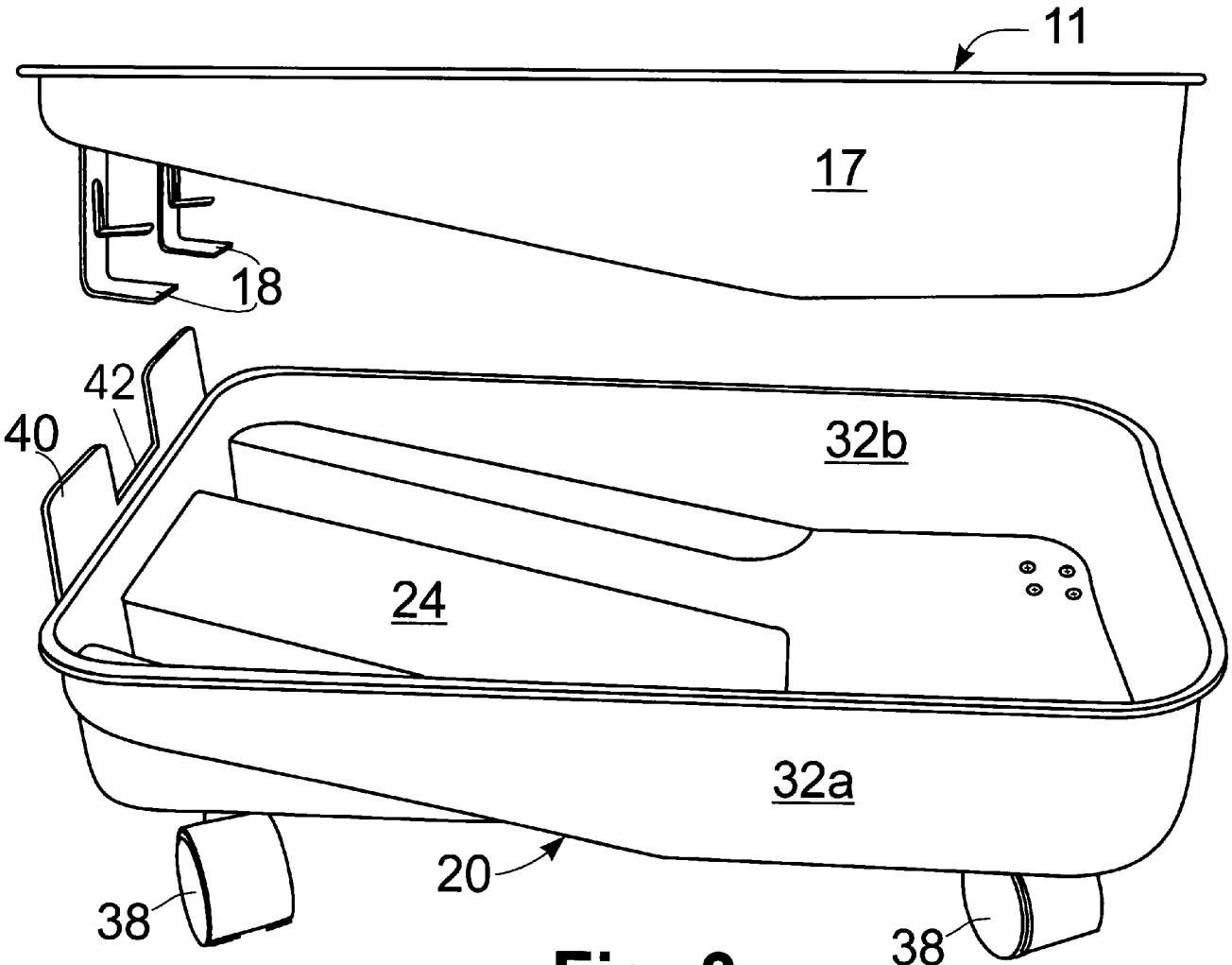
FIG. 3 is an exploded side perspective view of the trolley and tray depicted in FIG. 1.

The paint tray trolley of the present invention is depicted in FIGS. 1-3 generally at 20. Trolley 20 includes a base 22 which receives paint tray 11. Paint tray 11 is a conventional paint tray with a sloping bottom 13 with ribs 14, flat bottom portion 15, upwardly extending sides 16 and ends 17 with two downwardly projecting clips or feet 18 which serve to level tray 11 when it is sitting on a flat surface and permit the tray 11 to be clipped to the step of a ladder. It is noted that the clips 18 are typically inadequate to support the weight of the paint-ladened tray 11 and wind up spilling the tray's contents in the most undesirable spots, another good reason to find an alternative to painting from a ladder.

Base 22 has a first downwardly sloping floor portion 24 (FIG. 2) which underlies at least a portion of the sloping bottom 13. Slot means 26*a* and 26*b* are provided to accommodate the clips 18, with first downwardly sloping floor portion 24 lying intermediate slot means 26*a* and 26*b*. Second and third downwardly sloping floor portions 28*a* and 28*b* lie laterally outwardly from the slot means 26*a* and 26*b*, respectively. A flat floor portion 30 is provided to underlie the flat bottom portion 15 of tray 11. Two side walls 32*a*, 32*b* extend upwardly on base 22 and are configured to enclose (lie closely adjacent and engage) sides 16, 17 to prevent relative movement between trolley 20 and tray 11.

Similarly, front wall 34 and back wall 36 extend upwardly on base 22 and are configured to enclose ends 17 to prevent relative longitudinal motion between the trolley 20 and the paint tray 11. In fact, trolley 20 is designed to fit around tray 11 like a glove on a hand. Rotational support means, in this instance, casters 38, are positioned adjacent the four corners of trolley 20 and each are attached using four screw-nut pairs 39. Casters 38 pivot about generally vertical axes to permit change in direction. Obviously other attachment means could be used without departing from the scope of the invention. Indeed, it is envisioned that recesses could be molded directly on the bottom of base 22 which could receive via snap fit, the pintle of a different style caster. Further, non-pivoting wheels could be used at the forward end 23 of trolley 20 as a cost reduction since only the rear wheels need pivot to permit steering (lateral movement) of the trolley 20.

Upwardly extending flange 40 is attached to the rear end 21 of trolley 20 to facilitate manipulation (rolling) of the trolley 20 by the paint roller (not shown). As previously mentioned, serious painters use an extensible handle which attaches to the handle of the roller and permits floor-to-ceiling application from a standing position without the need of a ladder. Most paint rollers have a centrally positioned handle with a laterally extending support arm. The roller and the support arm can sandwich upwardly extending flange 40 and be used to push/pull the trolley 20 wherever the painter would like. A slot 42 is provided in flange 40 to accommodate other style rollers where central clearance is needed for the roller's handle. Although not depicted in the drawing, the trolley 20 does not prevent the use of a plastic liner in tray 11 since there are no impediments above the surface of tray 11. Such disposable liners are used by professional painters to facilitate cleanup.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A paint tray trolley for a conventional paint tray having a sloping bottom, two ends and two sides forming a contiguous peripheral wall, and two clips underlying the sloping bottom permitting the paint tray to be mounted upon a step of a ladder, said trolley comprising a. a base underlying at least a portion of the conventional paint tray, said base having a first downwardly sloping floor portion which partially underlies and supports the sloping bottom of the paint tray and means to accommodate the two clips which are beneath the sloping bottom, wherein said first downwardly sloping floor portion lies between two portions of said means to accommodate the two clips;

b. two side walls extending upwardly on said base enclosing the two sides of the paint tray to inhibit relative lateral motion between said trolley and the paint tray;

c. front and back walls extending upwardly on said base contiguous with said two side walls, said front and back walls enclosing the two end walls of the paint tray to inhibit relative longitudinal movement between said trolley and the paint tray;

c. rotational support means beneath and attached to said base to permit said paint tray trolley to be moved from place to place without a need for said trolley to be picked up.

2. The paint tray trolley of claim 1 further comprising upwardly extending flange means attached to one of said front and back walls, said flange means being engageable by a paint roller to facilitate manipulation of said paint tray trolley.

3. The paint tray trolley of claim 2 wherein said flange means has a slot formed between a first portion and a second portion to accommodate a handle of the paint roller.

4. The paint tray trolley of claim 1 further comprising second and third auxiliary sloping floor portions formed in said base lying laterally outwardly from said means to accommodate the two clips.

5. The paint tray trolley of claim 1 wherein said rotational support means comprises a plurality of wheels attached to a lower side of said base.

6. The paint tray trolley of claim 5 wherein at least two of said plurality of wheels comprise casters capable of rotation about a generally vertical axis to facilitate lateral movement of said paint tray trolley.

7. The paint tray trolley of claim 6 wherein said plurality of wheels comprise at least a total of four.

8. The paint tray trolley of claim 7 where all of said plurality of wheels comprise casters.

* * * * *